US006357423B1

(12) United States Patent
Kanno

(10) Patent No.: US 6,357,423 B1
(45) Date of Patent: Mar. 19, 2002

(54) FUEL INJECTION FOR ENGINE

(75) Inventor: Isao Kanno, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/497,570

(22) Filed: Feb. 3, 2000

(30) Foreign Application Priority Data

Feb. 3, 1999 (JP) ..... 11-25778

(51) Int. Cl.[7] ..... F02M 37/04
(52) U.S. Cl. ..... 123/497; 123/514
(58) Field of Search ..... 123/497, 495, 123/480, 514, 357, 358, 359

(56) References Cited

U.S. PATENT DOCUMENTS

| | | | | | |
|---|---|---|---|---|---|
| 3,967,598 | A | * | 7/1976 | Rachel | 123/497 |
| 4,430,980 | A | | 2/1984 | Pidgeon | 123/497 |
| 4,577,604 | A | | 3/1986 | Hara et al. | 123/397 |
| 4,800,859 | A | | 1/1989 | Sagisaka et al. | 123/497 |
| 4,867,120 | A | | 9/1989 | Boda et al. | 123/195 P |
| 4,884,545 | A | | 12/1989 | Mathis | 123/447 |
| 4,919,102 | A | | 4/1990 | Iwabuchi | 123/499 |
| 4,920,942 | A | | 5/1990 | Fujimori et al. | 123/497 |
| 4,926,829 | A | | 5/1990 | Tuckey | 123/497 |
| 5,085,193 | A | | 2/1992 | Morikawa | 123/458 |
| 5,103,793 | A | | 4/1992 | Riese et al. | 123/516 |
| 5,309,885 | A | | 5/1994 | Rawlings et al. | 123/509 |
| 5,375,578 | A | | 12/1994 | Kato et al. | 123/516 |
| 5,379,741 | A | * | 1/1995 | Matysiewicz et al. | 123/497 |
| 5,389,245 | A | | 2/1995 | Jaeger et al. | 210/129 |
| 5,406,922 | A | * | 4/1995 | Tuckey | 123/497 |
| 5,411,002 | A | | 5/1995 | Smitley | 123/497 |
| 5,477,833 | A | * | 12/1995 | Leighton | 123/497 |
| 5,740,783 | A | * | 4/1998 | Learman et al. | 123/497 |

* cited by examiner

*Primary Examiner*—Henry C. Yuen
*Assistant Examiner*—Mahmoud Gimie
(74) *Attorney, Agent, or Firm*—Knobbe, Martens, Olson & Bear, LLP

(57) ABSTRACT

A fuel injection system for an engine includes an improved construction to inhibit heating of the fuel. A fuel reservoir is arranged to store the fuel therein. A fuel pump is provided for delivering the fuel in the reservoir to a fuel injector which sprays fuel toward a combustion chamber of the engine. The fuel pump is driven by an electric motor that is intermittently powered. In one embodiment, a control device is provided for controlling the duration for which the electric motor is powered. A duty ratio of the duration is preferably determined in response to an amount of the fuel that is required to be sprayed by the fuel injector.

27 Claims, 4 Drawing Sheets

Intake Air Pressure (Pa)

| (rpm) Engine Speed | 0 | 100 | 200 | 400 | 800 | 1000 |
|---|---|---|---|---|---|---|
| 500 | $T_{11}$ | ••• | ••• | ••• | ••• | ••• |
| 1000 | ••• | $T_{22}$ | $T_{32}$ | | | |
| 2000 | ••• | $T_{23}$ | $T_{33}$ | | | |
| 4000 | ••• | | | $T_{44}$ | | |
| 6000 | ••• | | | | | $T_{mn}$ |

| | | | | |
|---|---|---|---|---|
| Injected Amount Tmn (msec) | 0 | $T_{11}$ | ••• | $T_{mn}$ |
| Delivery Amount Pf (ml/sec) | 0 | $T_{11}' + \alpha$ | ••• | $T_{mn}' + \alpha$ |
| Duty Ratio Dmn (%) | 0 | $D_{11}$ | ••• | 100 |

FUEL INJECTION FOR ENGINE

BACKGROUND OF THE INVENTION

1. Field of the Invention

This invention relates to fuel injection for an engine, and more particularly to a fuel injection system that is suitable for an outboard motor.

2. Description of Related Art

In the interest of improving engine performance and particularly fuel efficiency and exhaust emission control, many types of engines now employ a fuel injection system for supplying fuel to the engine. In this system, generally fuel is injected into an air induction device by a fuel injector. This fuel injection has the advantages of permitting the amount of fuel delivered for each cycle of the engine to be adjusted. In addition, by utilizing the fuel injection system, it is possible to maintain the desired fuel air ratio under a wide variety of engine running condition.

The amount of fuel injected by the fuel injector is usually controlled by a control device in response to the engine running conditions. More specifically, the fuel is delivered to the fuel injector by a fuel pump under a certain fixed pressure and duration for injection per unit time, i.e., a duty ratio, is controlled by the control device so that any required amount can be measured. Strict control of the fuel amount is quite important for stable operation of the engine.

Some outboard motors incorporate such a fuel injection system. Typically outboard motors are constructed to be easily unmounted from the associated watercraft for being carried to, for example, a repair factory. Engines for the outboard motors, thus, should be as compact as possible despite that they are required to be quite powerful relative to such compact bodies. Because of this reason, the engines for the outboard motors are not allowed to employ a large-scale cooling system. In addition, since the engines are generally enclosed in protective cowlings, the heat radiated from the engines during operations is likely to be retained within the cowlings. Under the circumstances, bubbles or vapor can appear in the fuel that will be injected by the fuel injector and may harm the strict control of the fuel amount.

In order to inhibit the vapor from entering the fuel, usually a vapor separator is provided in the fuel injection system that is employed for the engine of the outboard motor. The fuel injection system includes, therefore, a main fuel supply tank disposed in the hull of the associated watercraft, and the vapor separator mounted on, for example, the engine. The fuel in the main tank is delivered to the vapor separator with a low pressure fuel pump and then the vapor, if any, is separated from the fuel. The fuel is delivered to the fuel injector with a high pressure pump and injected into the air induction device by the fuel injector. The excess fuel that has not been injected returns to the vapor separator through a return passage.

The high pressure fuel pump is usually unified with an electric motor, which drives the pump, as a pump unit. The pump unit is usually positioned within the vapor separator because the engine can hardly provide a space for disposing the fuel pump out of the vapor separator. The electric motor, however, is likely to produce heat therein when operating. The heat, therefore, may be conducted to the fuel. Due to this arrangement and construction, the problem that the vapor can be made in the fuel may still not be completely resolved.

In addition, the high pressure pump is operated to deliver the maximum amount of the fuel that meets the highest engine speed and/or the largest load. Thus, the lower the engine speed and/or the smaller the load, the greater the excess fuel will return to the vapor separator. This situation leads to the increase of heat in the fuel more and more.

As one way to resolve the problem, a resistor is provided in a control circuit or controller that drives the electric motor, and the resistor can be switched over when the engine is operated under a low engine speed and/or low load to reduce current in the circuit. Alternatively, a variable resistor also can be employed for reducing the current under the same condition. This may be advantageous for decreasing the heat in the fuel. However, on the other hand, this approach increases the manufacturing cost of the engine and eventually the total cost of the outboard motor.

A similar problem may occur with other engines, irrespective of being incorporated with outboard motors, inasmuch as the pump unit is disposed in the vapor separator. The problem may also occur if the heat produced by the pump unit is conducted to the fuel by some means even though the unit is not placed within the vapor separator.

A need therefore exists for an improved fuel injection control that reduces undesirably heating of the fuel within the fuel supply system without increasing the cost therefor.

SUMMARY OF THE INVENTION

In accordance with one aspect of the present invention, an internal combustion engine comprises a cylinder body defining a cylinder bore in which a piston reciprocates. A cylinder head is affixed to an end of the cylinder and defines a combustion chamber with the cylinder head and the piston. A fuel injector supplies fuel to the combustion chamber. A fuel pump delivers the fuel from a reservoir to the fuel injector. An intermittently powered electric motor drives the fuel pump.

In accordance with another aspect of the present invention, a fuel injection system is provided for an internal combustion engine having a combustion chamber. The system comprises a fuel injector supplying fuel to the combustion chamber. A fuel reservoir is arranged to store the fuel therein. Means are provided for delivering the fuel in the reservoir to the fuel injector. The delivering means operates intermittently.

In accordance with a further aspect of the present invention, a fuel injection system is provided for an internal combustion engine having a combustion chamber. The system comprises a fuel injector supplying fuel to the combustion chamber. A fuel reservoir is arranged to store the fuel therein. A fuel delivery mechanism delivers the fuel in the reservoir to the fuel injector. A control device activates the delivery mechanism intermittently.

In accordance with still a further aspect, a method of operating an internal combustion engine is provided. The engine has a combustion chamber, a fuel injector, and a fuel supply mechanism for supplying the fuel to the fuel injector. The fuel supply mechanism is activated intermittently in response to the amount of the fuel needed. The method involves sensing at least one of the engine speed and the engine load, and determining the amount of fuel to be injected by the fuel injector toward the combustion chamber.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention.

DETAILED DESCRIPTION OF THE PREFERRED EMBODIMENT OF THE INVENTION

Figure 1:
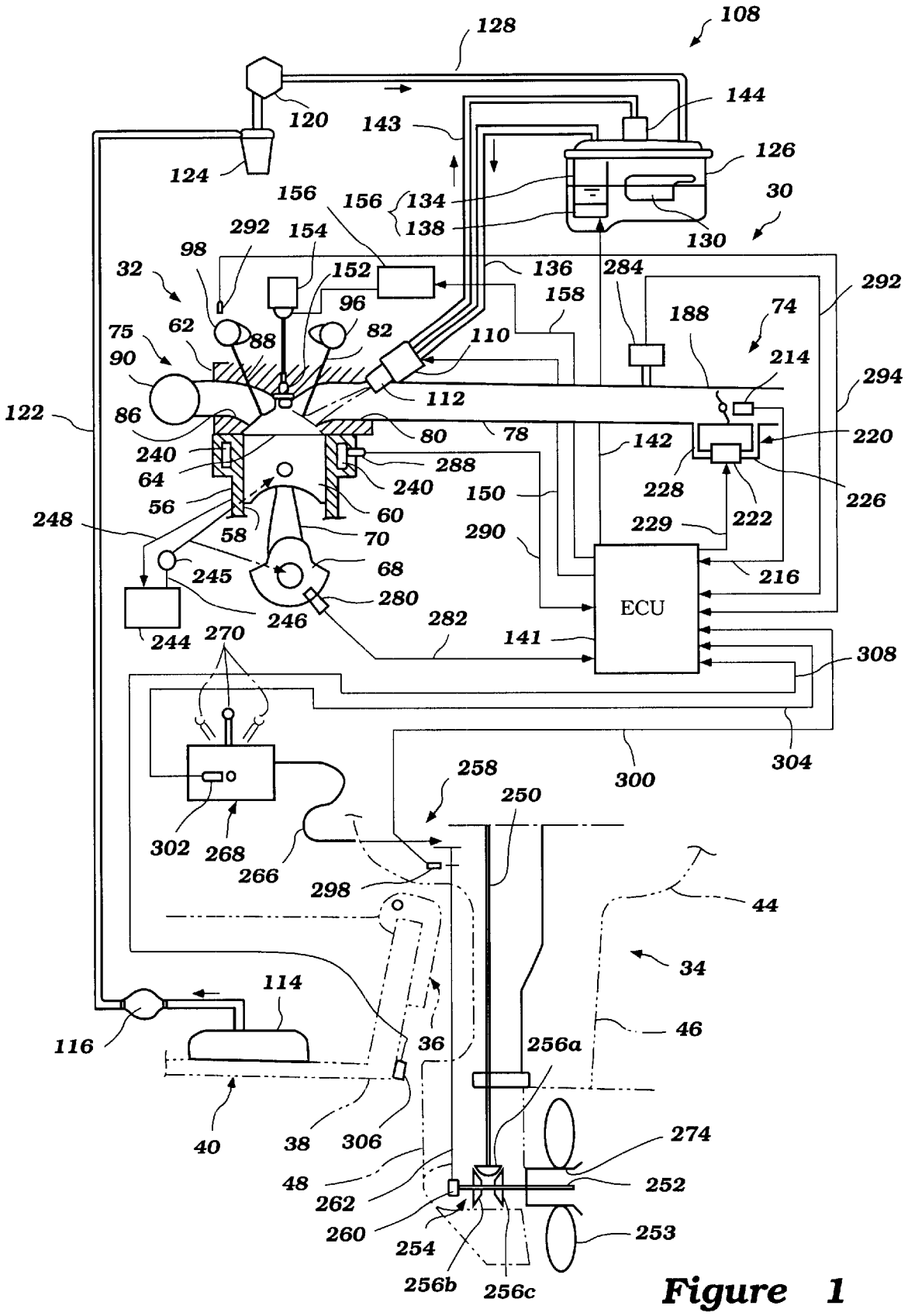
FIG. 1 is a schematic view showing an outboard motor in accordance with a preferred embodiment of the present invention. An engine, in part, and a control device are shown in the upper half view. The outboard motor, in part, with a transmission, a shift device of the transmission and an associated watercraft are shown in the lower half view. An ECU (Engine Control Unit) for the motor and a fuel supply line link the two views together. The outboard motor and associated watercraft are partially illustrated in phantom.
Figure 2:
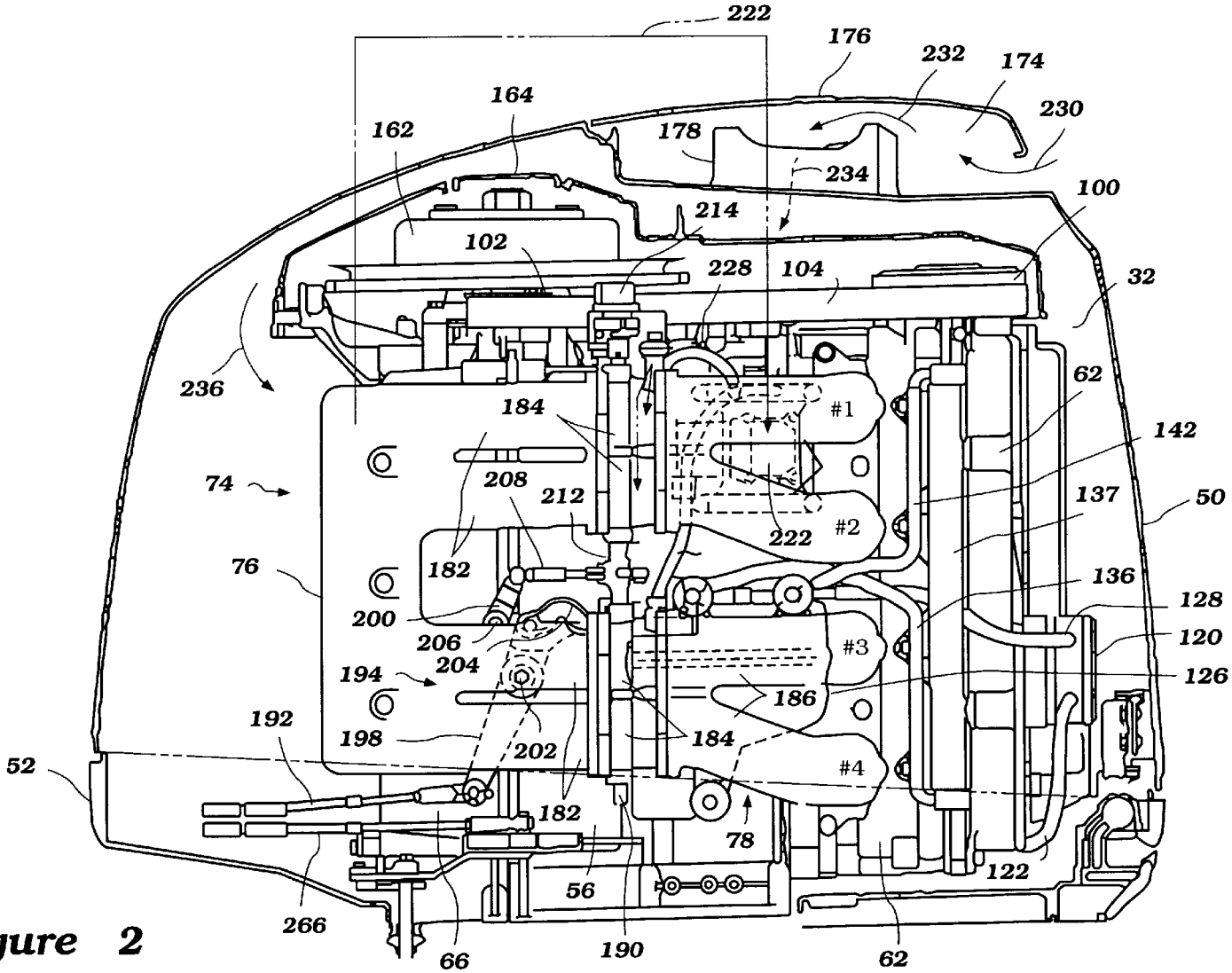
FIG. 2 is an elevational side view showing the actual outboard motor, particularly its power head incorporating the engine. A top and bottom protective cowling are sectioned.
Figure 3:
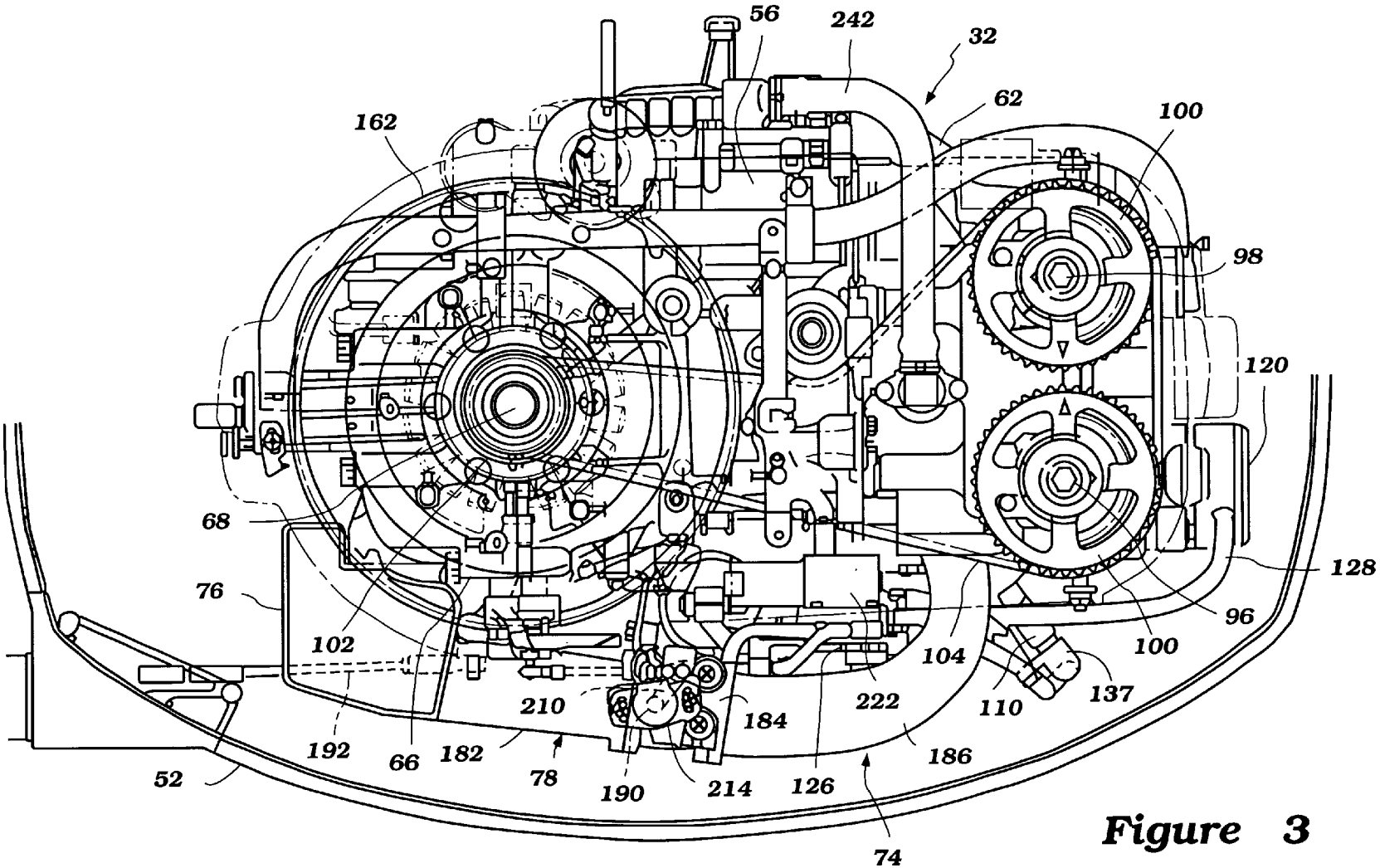
FIG. 3 is a top plan view showing the same motor and engine. The top protective cowling is removed and a half part of the bottom cowling is omitted.

With reference to FIGS. 1 to 3, an outboard motor, designated generally by the reference numeral 30, includes an internal combustion engine 32 arranged in accordance with a preferred embodiment of the present invention. Although the present invention is shown in the context of an engine for an outboard motor, various aspects and features of the present invention also can be employed with engines for other types of marine outboard drive units (e.g., a stern drive unit) and also, for example, for land vehicles.

In the illustrated embodiment, the outboard motor 30 comprises a drive unit 34 and a bracket assembly 36. Although schematically shown in FIG. 1, the bracket assembly 36 actually comprises a swivel bracket and a clamping bracket. The swivel bracket supports the drive unit 34 for pivotal movement about a generally vertically extending steering axis. The clamping bracket, in turn, is affixed to a transom 38 of an associated watercraft 40 and supports the swivel bracket for pivotal movement about a generally horizontally extending axis. Since these types of constructions are well known in the art, further description of them is not believed to be necessary to permit those skilled in the art to practice the invention.

As used in this description, the terms "forward" and "front" mean at or to the side where the bracket assembly 36 is located, and the terms "rear," "reverse" and "rearwardly" mean at or to the opposite side of the front side, unless indicated otherwise.

The drive unit 34 includes a power head 44, a driveshaft housing 46 and a lower unit 48. The power head is disposed atop of the drive unit 34 and includes the engine 32, a top protective cowling 50 and a bottom protective cowling 52 (see FIG. 2).

The engine 32 operates on a four stroke cycle principle and powers a propulsion device. As seen in the upper view in FIG. 1 and FIGS. 2 and 3, the engine 32 has a cylinder body 56. The cylinder body 56 defines four cylinder bores 58 generally horizontally extending and spaced generally vertically with each other. A piston 60 can reciprocate in each cylinder bore 58. A cylinder head assembly 62 is affixed to one end of the cylinder body 56 and defines four combustion chambers 64 with the pistons 60 and the cylinder bores 58. The other end of the cylinder body 56 is closed with a crankcase member 66 defining a crankcase chamber with the cylinder bores 58. A crankshaft 68 extends generally vertically through the crankcase chamber. The crankshaft 68 is pivotally connected with the pistons 60 by connecting rods 70 and rotates with the reciprocal movement of the pistons 60. The crankcase member 66 is located at the most forward position, the cylinder body 56 and the cylinder head assembly 62 extend rearwardly from the crankcase member 66, one after another.

The engine 32 includes an air induction system 74 and exhaust system 75. The air induction system 74 is arranged to supply air charges to the combustion chambers 64 and comprises a plenum chamber 76, four main air intake passages 78 (see FIG. 2) and four intake ports 80. The intake ports 80 are defined in the cylinder head assembly 62 and opened or closed by intake valves 82. When the intake ports 80 are opened, the air intake passages 78 communicate with the combustion chambers 64. The air induction system 74 will be described in more detail later.

The exhaust system 75 is arranged to discharge burnt charges or exhaust gasses outside of the outboard motor 30 from the combustion chambers 56. Exhaust ports 86 are defined in the cylinder head assembly 62 also and opened or closed by exhaust valves 88. When the exhaust ports 86 are opened, the combustion chambers 64 communicate with an exhaust manifold 90 which collects exhaust gasses and leads them downstream of the exhaust system 75. The exhaust gasses, in major part, are discharged to the body of water surrounding the outboard motor 30 through exhaust passages formed in the driveshaft housing 46 and lower unit 48.

An intake camshaft 96 and exhaust camshaft 98 both extend generally vertically to activate the intake valves 82 and exhaust valves 88. These camshafts 96, 98 have cam lobes thereon to push the intake valves 82 and exhaust valves 88 at certain timings to open or close the respective ports 80, 86.

The camshafts 96, 98 are journaled on the cylinder head assembly 62 and driven by the crankshaft 68. As best seen in FIG. 3, the respective camshafts 96, 98 have cogged pulleys 100 thereon, while the crankshaft 68 also has a cogged pulley 102 thereon. A cogged belt or chain 104 is wound around the cogged pulleys 100, 102. With rotation of the crankshaft 68, therefore, the camshafts 96, 98 rotate also.

The engine 32 has a fuel injection system 108. The fuel injection system 108 includes four fuel injectors 110 which have injection nozzles 112 exposed to the intake ports 80 so that injected fuel is directed toward the combustion chambers 64. A main fuel supply tank 114 is also included and placed in the hull of the associated watercraft 40. Fuel is drawn from the fuel tank 114 by a first low pressure fuel pump 116 and a second low pressure pump 120 through a first fuel supply conduit 122. The first low pressure pump 116 is a manually operated pump. The second low pressure pump 120 is a diaphragm type operated by one of the intake and exhaust camshafts 96, 98. In the illustrated embodiment, it is mounted on the cylinder head assembly 62.

A quick disconnect coupling (not shown) is provided in the first conduit 122. Also a fuel filter 124 is positioned in the conduit 122 at an appropriate location.

From the low pressure pump 120, the fuel is supplied to a vapor separator or fuel reservoir 126 through a second fuel supply conduit 128. In the illustrated embodiment, the vapor separator 126 is mounted on the main air intake passage 78 rather than on the cylinder body 56. Because the heat in the engine 32 is not conducted to the vapor separator directly in this arrangement. At the vapor separator end of the conduit 128, there is provided a float valve (not shown) that is operated by a float 130 so as to maintain a uniform level of the fuel contained in the vapor separator 126.

A high pressure fuel pump 134 is provided in the vapor separator 126 and pressurizes the fuel that is delivered to the fuel injectors 110 through a delivery conduit 136. Actually, the fuel injectors 110 are supported by a fuel rail 137 and this fuel rail 137 is a portion of the delivery conduit 136. The fuel injectors, however, can be supported on the cylinder head or cylinder body and be connected to the fuel pump by sections of conduits or pipes that together form the fuel rail.

The fuel pump 134 in the illustrated embodiment preferably is a positive displacement pump. The construction of the pump thus generally inhibits fuel flow from its upstream side back into the vapor separator 126 when the pump is not running. Although not illustrated, a back-flow prevention device (e.g., a check valve) can, in addition or in the alternative, be used to prevent a flow of fuel from the delivery conduit 136 back into the vapor separator 126 when the pump is off. This later approach can be used with a fuel pump that employs a rotary impeller to inhibit a drop in pressure within the delivery conduit 136 when the pump is intermittently stopped.

The high pressure fuel pump 134 is driven by an electric motor 138 which in the illustrated embodiment is unified with the pump 134 at its bottom portion; however, the arrangement of these components can be reversed. The electric motor 138 is, therefore, positioned in the vapor separator 126 also. The high pressure fuel pump 134 and electric motor 138 together form a pump unit or fuel delivery mechanism 140. In the illustrated embodiment, the electric motor 138 is intermittently activated under control of an ECU (Engine Control Unit) 141, which is electronically operated, through a signal line 142. This control and the ECU 141 will be described more in detail later.

A fuel return conduit 143 is also provided between the fuel injector 110 and the vapor separator 126. The excess fuel that is not injected by the injector 110 returns to the vapor separator 126 through this conduit 143. A pressure regulator 144 is mounted on the vapor separator 126 and at the end of the return conduit 143 to limit the pressure that is delivered to the fuel injectors 110 by dumping the fuel back to the vapor separator 126.

A necessary amount of the fuel is sprayed into the intake ports 80 through the injection nozzles 112 of the fuel injectors 110 at the proper time, and then enters the combustion chambers 64 with an air charge when the intake valves 82 are opened. The amount of the fuel and injection timing are controlled by the ECU 141 through a signal line 150.

The engine 32 further has a firing system. Four spark plugs 152 are exposed into the respective combustion chambers 64 and fire an air fuel charge at each preset timing. For this purpose, the firing system has an ignition coil 154 and igniter 156 which are connected to the ECU 141 through a signal line 158 so that the firing timings are also controlled by the ECU 141. The air fuel charge is formed with an air charge supplied by the main air intake passages 78 and with a fuel charge sprayed by the fuel injectors 110.

As seen in FIGS. 2 and 3, a flywheel assembly 162 is affixed atop of the crankshaft 68. The flywheel assembly 162 includes a generator that supplies electric power to the firing system, electric motor 138, ECU 141 and other electrical equipment. A cover member 164 covers the flywheel assembly 162, pulleys 100, 102 and the belt 104 for protection of the operator or occupant of the watercraft 40 from such moving parts when the top cowling 50 is detached.

The top and bottom cowlings 50, 52 generally completely enclose the engine 32. The top cowling 50 is detachably affixed to the bottom cowling 52 so that the operator can access the engine 32 for maintenance or other purposes. As seen in FIG. 2, the top cowling 50 defines a pair of air intake compartments 174 with compartment members 176 and recesses at both rear sides thereof. Each air intake compartment 174 has an air funnel 178 that stands in the compartment 174. The air intake compartments 174, thus, communicate with the interior of the protective cowlings 50, 52.

The aforenoted plenum chamber 76 is positioned on the port side of the crankcase member 66. The plenum chamber 76 has an inlet opening (not shown) that opens to the interior of the protective cowlings 50, 52 at its front side. The plenum chamber 76 functions as an intake silencer and/or a coordinator of air charges. The main air intake passages 78 extend rearwardly from the plenum chamber 76 along the cylinder body 56 and then curve toward the intake ports 80. The air intake passages 78 are actually defined by duct sections 182 which are uniformly formed with the plenum chamber 76, throttle bodies 184 and runners 186. The upper, two throttle bodies 184 are unified with each other. The upper, two runners 186 are also uniformly formed with each other at their fore portions and then forked into two portions. The lower, two throttle bodies 184 and runners 186 have the same constructions as the upper, two throttle bodies 184 and runners 186. The aforenoted vapor separator 126 is affixed to the lower, two runners 186. The air intake passages 78 comprising the members 182, 184, 186 extend generally horizontally along the respective cylinder bores 58 spaced generally vertically with each other. As indicated in FIG. 2, the air intake passages 78 are numbered as #1 through #4 from the top to the bottom for convenience in this description.

The respective throttle bodies 184 support butterfly-type throttle valves 188 therein for pivotal movement about axes of valve shafts extending generally vertically. The valve shafts are linked together to form a single valve shaft 190 that passes through the entire throttle bodies 184. The throttle valves 188 are operable by the operator through a throttle cable 192 and a non-linear control mechanism 194.

The non-linear control mechanism 194 includes a first lever 198 and a second lever 200 joined to each other by a cam connection. The first lever 198 is pivotally connected to the throttle cable 192 and pivotally connected to a first pin 202 which is affixed to the cylinder body 56. The first lever 198 has a cam hole 204 at the opposite end of the connection with the throttle cable 192. The second lever 200 is generally L-shaped and pivotally connected to a second pin 206 which is affixed to the crankcase member 66. The second lever 186 has a pin 207 that interfits the cam hole 190. The other end of the second lever 200 is pivotally connected to a control rod 208, which, in turn, is pivotally connected to a lever 210 (see FIG. 3). The lever 210 is, then, connected to the throttle valve shaft 190 via a torsion spring 212 that urges the control rod 208 to a position shown in FIG. 2. At this position of the control rod 208, the throttle valve shaft 190 is in a closed position wherein almost no air charge can pass through the air intake passages 78.

When the throttle cable 192 is operated, the first lever 198 pivots about the first pin 202 anti-clockwise in FIG. 2. The second lever 200, then, pivots about the second pin 206 clockwise. Since the pin 207 of the second lever 200 is interfitted in the cam hole 204, the second lever 200 moves along this cam shape. Then, the second lever 200 pushes the control rod 208 against the biasing force of the torsion spring 212 to open the throttle valves 188. When the throttle cable 192 is released, the control rod 208 returns to the initial position by the biasing force of the spring 212 and the throttle valves 188 are closed again.

A throttle valve position sensor 214 is placed atop of the throttle valve shaft 190. A signal from the position sensor 214 is sent to the ECU 141 through a signal line 216 for the idle speed control, fuel injection control and other controls. The signal from this throttle valve position sensor 214 represents the engine load in one aspect as well as the throttle opening per se.

The air induction system 74 further includes a bypass passage or idle air supply passage 220 that bypasses the throttle valves 188. An idle air adjusting unit 222, which incorporates a butterfly valve or another kind of valve therein, is provided in the bypass passage 220. Actually, the idle air adjusting unit 222 is located between the cylinder body 56 and the main air intake passages 78 and affixed to the #1 and #2 runners 186 like the vapor separator 126. This is again effective for the idle air adjusting unit 222 because the heat in the cylinder body 56 does not conduct to it. An inlet bypass 226, which is shown schematically with the phantom line in FIG. 2, connects the plenum chamber 76 with the adjusting unit 222. A pair of outlet bypasses 228 connect the adjusting unit 222 with bypass inlet ports which are positioned on the #1 throttle body 184 and #3 throttle body 184 downstream of the throttle valves 188. An opening of the valve in the idle air adjusting unit 222 is controlled by the ECU 141 through a signal line 229 also.

Air is introduced, at first, into the air intake compartments 174 as indicated by the arrow 230 and enters the interior of the top cowling 50 through the air funnels 178 as indicated by the arrows 232, 234. Then, the air goes down to the inlet opening of the plenum chamber 76 as indicated by the arrow 236 and enters the plenum chamber 76. The plenum chamber 76 attenuates intake noise and delivers air charges to the respective duct sections 182.

Under running conditions above idle, an air charge amount is controlled by the throttle valves 188 to meet the requirements of the engine 32. The air charge flows through the runners 186 to reach the intake ports 80. As described above, the intake valves 82 are provided at these intake ports 80. Since the intake valves 82 are opened intermittently by the cam lobes of the intake camshaft 96, the air charge is supplied to the combustion chambers 64 when the intake valves 82 are opened.

Under the idle running condition, the throttle valves 188 are substantially closed, although a very small opening is still maintained. Thus, air is directed to the idle air adjusting unit 222 in the bypass passage 220 that is controlled by the ECU 141, as noted above. That is, the valve in the unit 222 is repeatedly being opened and closed in corresponding to the opening of the throttle valves 188 and in response to fluctuations in the engine load and air charge amount passing through the throttle valves 188. The idle air charge adjusted in the idle air adjusting unit 222, then, returns to the main passages 78, i.e., runners 186 and supplied to the combustion chambers 64 as well.

The engine 32 has a cooling system for cooling heated portions such as the cylinder body 56 and cylinder head assembly 62. In the illustrated embodiment, a water jacket 240 is shown in FIG. 1 as provided in the cylinder block 56. A water discharge pipe 242 (see FIG. 3) is also provided and the cooling water is discharged outside of the outboard motor 30 through the discharge pipe 242. Because of the compactness, the outboard motor 30 is not allowed to have a large-scale cooling system as noted above.

The engine 32 also has a lubrication system, which is rather schematically shown in FIG. 1, for lubricating certain portions of the engine 32 such as, for example, the pivotal joints of the connecting rod 70 with the crankshaft 68 and with the piston 60. A lubricant reservoir 244 is disposed at a proper location in the driveshaft housing 46. Lubricant in the reservoir 244 is withdrawn by an oil pump 245 and delivered to the portions which need lubrication through a supply line 246. After lubricating the portions, the lubricant returns to the lubricant reservoir 244 through a return line 248 and repeats this circulation. That is, the lubrication system is formed as a closed loop.

As seen in the lower half view in FIG. 1, the driveshaft housing 46 depends from the power head 44 and supports a driveshaft 250 which is driven by the crankshaft 68 of the engine 32. The driveshaft 250 extends generally vertically through the driveshaft housing 46. The driveshaft housing 46 also defines internal passages which form portions of the exhaust system 75.

The lower unit 48 depends from the driveshaft housing 46 and supports a propeller shaft 252 which is driven by the driveshaft 250. The propeller shaft 252 extends generally horizontally through the lower unit 48. In the illustrated embodiment, the propulsion device includes a propeller 253 that is affixed to an outer end of the propeller shaft 252 and is driven thereby. A transmission 254 is provided between the driveshaft 250 and the propeller shaft 252. The transmission 254 couples together the two shafts 250, 252 which lie generally normal to each other (i.e., at a 90° shaft angle) with bevel gears 256*a*, 256*b*, 256*c*.

The outboard motor 30 has a switchover mechanism 258 of the transmission 254 to shift rotational directions of the propeller 253 to forward, neutral or reverse. The switchover mechanism 258 includes a shift cam 260, shift rod 262 and shift cable 266. The shift rod 262 extends generally vertically through the driveshaft housing 46 and lower unit 48, while the shift cable 266 is disposed in the lower protective cowling 52. The shift cable 266 extends outwardly from the lower cowling 52 and connects to a shift manipulator 268 which is located near a dashboard and a steering handle in the associated watercraft 40. The shift manipulator 268 is provided with a shift lever 270 to be operated by the operator. The switchover mechanism 258 is operable at certain engine speeds less than a predetermined speed.

The lower unit 48 also defines an internal passage that forms a discharge section of the exhaust system 75. At engine speed above idle, the majority of the exhaust gasses are discharged to the body of water surrounding the outboard motor 30 through the internal passage and finally through a hub 274 of the propeller 253.

With reference to FIGS. 1 and 4 to 6, the ECU 141 controls the engine operations, particularly, the firing system and the idle air adjusting unit 222 as well as the fuel injection system 108 with various control maps stored in the ECU 141. In order to determine appropriate control indexes in the maps or calculate them based upon the control indexes determined in the maps, various sensors other than the throttle valve position sensor 214 are provided for sensing engine conditions and other environmental conditions.

Associated with the crankshaft 68 is a crankshaft angle position sensor 280 which, when measuring crankshaft angle versus time, outputs a crankshaft rotational speed signal or engine speed signal that is sent to the ECU 141 through a signal line 282.

An intake air pressure sensor 284 senses air pressure in one of the main air passages 78. The sensed signal is sent to the ECU 110 through a signal line 236. This signal can be used for determining an engine load.

A water temperature sensor 288 at the water jacket 240 sends a cooling water temperature signal to the ECU 141 through a signal line 290.

A cylinder discrimination sensor 292 senses a rotational angle of the exhaust camshaft 98. The sensed signal is transmitted to the ECU 141 through a signal line 294.

Also, a shift position sensor 298 sends a signal indicating a position of the shift rod 262 (forward, neutral or reverse) to the ECU 141 through a signal line 300.

A lever operational speed sensor 302 senses a rotational speed of the shift lever 270, and its signal is sent to the ECU 141 through a signal line 304.

A watercraft velocity sensor 306 located at the lowermost portion of the transom 38 sends a signal to the ECU 141 through a signal line 308.

These sensors are well known and any one of such conventional sensors is applicable. Thus, further descriptions on them are not believed to be necessary.

As described above, an amount of the fuel injected by the fuel injectors 110 is controlled by the ECU 141 in response to various engine running conditions. More specifically, the fuel is delivered to the fuel injectors 110 by the high pressure fuel pump 134 under a certain fixed pressure regulated by the pressure regulator 144. Thus, the duration for which the nozzles 112 are opened per unit time, i.e., a duty ratio, is controlled by the ECU 141 so that any required amount can be measured. The method of injecting fuel is well known and no further description is believed to be necessary.

The pump unit 140 is disposed within the vapor separator 126 as noted above. The electric motor 138 of the pump unit 140 produces heat when it operates. This heat is conducted to the fuel contained in the vapor separator 126. In order to inhibit the heat from being produced by the electric motor 138, in this illustrated embodiment, the ECU 141 controls the electric motor 138 and thereby reduces its operation time.

Figures 4, 5, 6:
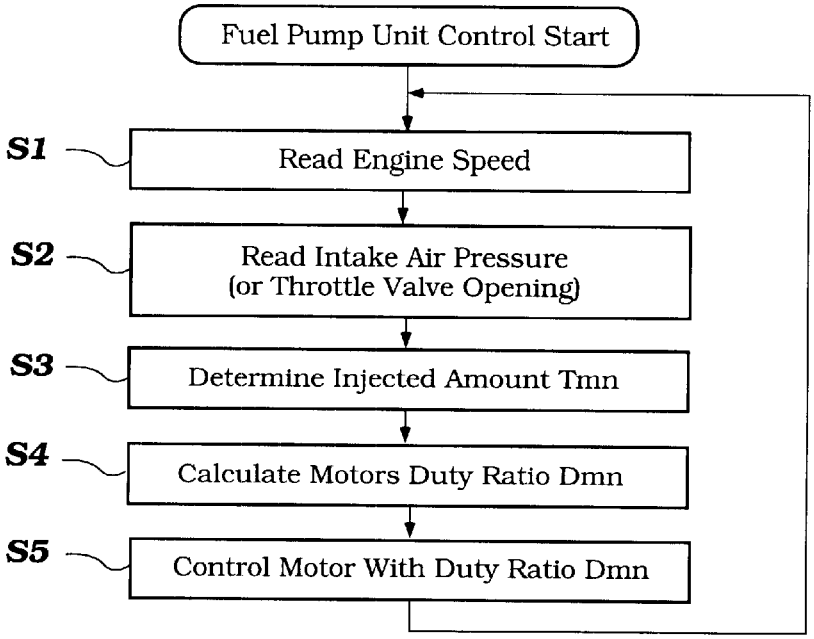
FIG. 4 is a graphical view showing a control routine for controlling a pump unit in a fuel injection system employed for the engine.
FIG. 5 is a control map showing the amounts of fuel that are required to be injected and that can be found with engine speeds versus intake air pressures.
FIG. 6 is a control map showing the injection amounts of fuel delivered from the pump unit corresponding to the injection amounts and duty ratios with which an electric motor operates, corresponding to the delivered fuel amounts.

FIG. 4 illustrates a control routine employed for this control.

As seen in this figure, the program starts and then moves to the step S1 to read the engine speed by means of the signal sent from the crankshaft angle position sensor 280. Next, the program goes to the step S2 to read the intake pressure by means of the signal sent from the intake pressure sensor 284. This step S2 is to grasp the engine load. It is alternatively practicable to read the throttle opening by means of the signal sent from the throttle valve position sensor 214.

The program then moves to the step S3 to determine the amount of fuel $T_{mn}$ which will be injected and corresponds to both of the engine speed and intake pressure (or throttle opening), which are specified at the steps of S1 and S2, in the control map shown in FIG. 5. It should be noted that the fuel amount $T_{mn}$ is actually represented by the duration for which the fuel is injected. If the engine speed is 1000 rpm and the intake pressure is 200 Pa, the fuel amount, i.e., the duration, $T_{mn}$ will be $T_{33}$ as found in FIG. 5. Although the actual map is more minute, if either one or both of the engine speed and intake pressure are not found in the map, it is practicable to calculate the fuel injection amount (duration) $T_{mn}$ by using either one or both of the nearest engine speed and the nearest intake pressure in a proper calculation manner.

The program then moves to the step S4 to calculate the duty ratio $D_{mn}$ of the electric motor 138. The duty ratio $D_{mn}$ is, like the duty ratio for the control of the fuel injector 110, the ratio of the time in which the electric motor 138 is powered or turned on to the unit time. The duty ratio $D_{mn}$ in this embodiment increases in proportion to the delivery amount $P_f$.

At first, as seen in FIG. 6, the ECU 141 calculates the amount of fuel $P_f$ to be delivery to the fuel injectors 110 from the fuel pump 134 based upon the injection amount $T_{mn}$. That is, primarily, the injection amount $T_{mn}$ is equal to the delivery fuel amount $P_f$. In the illustrated embodiment, however, the delivery amount $P_f$ is determined so as to be greater than the injection amount $T_{mn}$ and a fixed amount a is always added as seen in FIG. 6. Actually, the injection amount $T_{mn}$ is represented by the duration as noted above, it is converted to the dimension of the fuel amount $T'_{mn}$ and then the amount a is added. For instance, if the injection amount $T_{mn}$ is $T_{11}$, the delivery amount $P_f$ will be $(T'_{11}+\alpha)$. As seen again in FIG. 6, when the delivery amount $P_f$ is specified, then the duty ratio $D_{mn}$ of the electric motor 138 corresponding to the delivery amount $P_f$ is specified in the control map. If, for example, the delivery amount $P_f$ is calculated as $(T'_{11}+\alpha)$, then the duty ratio $D_{mn}$ will be $D_{11}$.

Adding the fixed amount a to the actual injection amount $T'_{mn}$ is advantageous because excess fuel is allowed to flow always through the pressure regulator and hence fluctuations in pressure for the fuel injection will be almost completely precluded.

Finally, the program goes to the step S5 to control the electric motor 138 with the duty ratio $D_{mn}$ obtained at the former step S4.

The electric motor 138 is intermittently powered or repeatedly turned on and off in response to the duty ratio $D_{mn}$ that is determined by the ECU 141 and drives the high pressure fuel pump 134. The pump 134, in turn, delivers the fuel in the vapor separator 126 to the fuel injectors 110 through the delivery conduit 136. The fuel injectors 110, then, spray the fuel into the air intake ports 80. The excess fuel returns to the vapor separator 126 through the return conduit 142.

By this intermittent operation, the electric motor 138 will not produce so much heat relative to the state in which it is powered at all times. Accordingly, even if the pump unit 140 is positioned in the vapor separator 126, the fuel therein will not be warmed up. In addition, since the ECU 141 is installed for control of the fuel injection system 108 whether the control of the electric motor 138 is necessary or not, this does not invite any increase of cost, not like having other specific devices such as a resistor and its controller.

The intermittent operation of the fuel pump motor is still advantageous even though the pump and electric motor unit is not positioned in the vapor separator.

In addition, the electric motor need not necessarily be unified with the fuel pump. For instance, the fuel pump can be remotely operated by the motor with a rotational power transmitting cable.

In the illustrated embodiment, the engine has the vapor separator spaced from the main fuel tank as a fuel reservoir. However, the main fuel tank can be the reservoir itself or other tanks or containers can still be the fuel reservoir. Also, the fuel reservoir is not necessarily mounted on the engine and can be remotely positioned therefrom.

The electric motor control in the aforedescribed embodiment of the present invention is quite beneficial for a four stroke engine. Because, as noted above, the four stroke engine usually includes a lubrication system of the circulation type. That is, lubricant in this system can hold the heat that is conducted from the engine and this heat, conversely, will be conducted to the fuel. However, the engine that can employ the electric motor control is not limited to the four stroke engine and, for example, a two stroke engine can also incorporate the control.

Both the engine speed and the engine load are not necessarily required. It is enough if at least one of them is involved. However, involvement of both can bring the control to a more accurate state.

Also, the duty ratio control is not necessarily applied. The electric motor only needs to be powered intermittently, although the control may improve the operation of the motor considerably.

Further, the fuel injector need not necessarily spray fuel to the air intake port. It can spray the fuel directly to the combustion chamber or to any portion of the air intake passages.

Of course, the foregoing description is that of preferred embodiments of the invention, and various changes and modifications may be made without departing from the spirit and scope of the invention, as defined by the appended claims.

What is claimed is:

1. An internal combustion engine comprising a cylinder body defining a cylinder bore in which a piston reciprocates, a cylinder head affixed to an end of the cylinder body and defining a combustion chamber with the cylinder head and the piston, a fuel injector supplying fuel to the combustion chamber, a fuel reservoir arranged to store the fuel therein, a fuel pump delivering the fuel in the reservoir to the fuel injector, and an electric motor driving the fuel pump, and a control device configured to control a duration for which the electric motor is powered, the control device configured to determine a duty ratio of the duration comprising a sum of fuel, the sum of fuel comprising an amount of the fuel required to be supplied to the combustion chamber by the fuel injector and a fixed predetermined amount of fuel.

2. An internal combustion engine as set forth in claim 1, wherein the predetermined amount of the fuel is fixed.

3. An internal combustion engine as set forth in claim 1 additionally comprising a sensor for sensing at least one of the engine speed and the engine load, and the control device determining an amount of the fuel required to be supplied by the fuel injector based upon an output of the sensor.

4. An internal combustion engine as set forth in claim 1 additionally comprising a fuel supply passage through which the fuel is delivered to the fuel injector from the fuel pump, and a fuel return passage through which the excess fuel that is not supplied by the fuel injector returns to the fuel reservoir.

5. An internal combustion engine as set forth in claim 4, wherein the return passage includes a pressure regulator.

6. An internal combustion engine as set forth in claim 1 additionally comprising an air induction system delivering an air charge to the combustion chamber, the fuel injector being configured to spray the fuel into the air induction system.

7. An internal combustion engine as set forth in claim 1, wherein the fuel reservoir includes a vapor separator, and the fuel pump delivers the fuel contained in the vapor separator to the fuel injector.

8. An internal combustion engine as set forth in claim 7, wherein the fuel pump is disposed within the vapor separator.

9. An internal combustion engine as set forth in claim 1 additionally comprising a fuel supply passage through which the fuel is delivered to the fuel injector from the fuel pump, and a fuel return passage through which the excess fuel that is not supplied by the fuel injector returns to the fuel reservoir.

10. An internal combustion engine as set forth in claim 9, wherein the return passage includes a pressure regulator.

11. An internal combustion engine as set forth in claim 1, wherein the engine powers a marine propulsion device.

12. An internal combustion engine as set forth in claim 11, wherein the engine is enclosed in a cowling.

13. An internal combustion engine as set forth in claim 1, wherein the engine is incorporated in an outboard motor.

14. An internal combustion engine as set forth in claim 1 additionally comprising a crankshaft connected with the piston by a connecting rod for rotation with the reciprocal movement of the piston, and a lubrication system arranged to lubricate at least a joint portion of the crankshaft with the connecting rod, and the lubrication system includes a closed loop through which the lubricant circulates.

15. An internal combustion engine as set forth in claim 1, wherein the engine operates on a four stroke cycle principle.

16. A fuel injection system for an internal combustion engine having a combustion chamber, comprising a fuel injector supplying fuel to the combustion chamber, a fuel reservoir arranged to store the fuel therein, delivery means for delivering the fuel in the reservoir to the fuel injector, and controlling means for controlling the duration of the delivery means, the controlling means including means for determining a duty ratio of the duration corresponding to a sum of the fuel delivered to the fuel injector and a fixed predetermined amount of fuel.

17. A fuel injection system as set forth in claim 16, wherein the controlling means controls the duration for which the delivering means operates.

18. A fuel injection system as set forth in claim 17, wherein the controlling means determines a duty ratio of the duration in response to an amount of the fuel that is required to be supplied by the fuel injector.

19. A fuel injection system as set forth in claim 18, wherein the controlling means determines an amount of the fuel delivered to the fuel injector to be grater than an actual amount of the fuel supplied by the fuel injector.

20. A fuel injection system as set forth in claim 16, wherein the engine is incorporated in an outboard motor.

21. A fuel injection system as set forth in claim 16, wherein the engine operates on a four stroke cycle principle.

22. A fuel injection system for an internal combustion engine having a combustion chamber, the system comprising a fuel injector supplying fuel to the combustion chamber, a fuel reservoir arranged to store the fuel therein, and a fuel delivery mechanism delivering the fuel in the reservoir to the fuel injector, and a control device activating the delivery mechanism intermittently, the control device being configured to determine a duty ratio of operation of the delivery mechanism in accordance with a sum of the fuel to be delivered to the fuel injector and a fixed predetermined amount of fuel.

23. A fuel injection system as set forth in claim 22, wherein the control device determines a duty ratio of the duration for which the delivery mechanism is activated in response to an amount of the fuel that is required to be supplied by the fuel injector.

24. A method of operating an internal combustion engine having a combustion chamber, a fuel injector, a fuel supply mechanism for supplying the fuel to the fuel injector and a sensor, the method comprising the steps of sensing at least one of the engine speed and the engine load by the sensor, determining a first amount of the fuel to be delivered to the combustion chamber based upon an output of the sensor, adding a fixed predetermined second amount of fuel to the first amount to provide make a third amount fuel, determining a duty ratio of a duration sufficient for the fuel supply mechanism to output the third amount of fuel, and activating intermittently the fuel supply mechanism based upon the determined duration.

25. An internal combustion engine comprising an engine body, a movable member movable relative to the engine body, the engine body and the movable member together defining a combustion chamber, a fuel injector configured to spray fuel for combustion in the combustion chamber, a fuel delivery mechanism arranged to deliver fuel to the fuel injector, a sensor configured to sense at least one of an engine speed and an engine load, a control system configured to control a duration for which the fuel delivery mechanism operates based upon an output of the sensor, the control system determining a duty ratio of the duration corresponding to a sum of a first amount of fuel required for the combustion and at least a second fixed additional amount of fuel that corresponds to at least a range of values of the first amount of fuel.

26. An internal combustion engine as set forth in claim 25 additionally comprising a control map comprising at least the range of values of the first amount of fuel correlated to corresponding engine speed values.

27. An internal combustion engine as set forth in claim 26, wherein the range of values of the first amount of fuel in the control map are also correlated to corresponding intake air pressure values.

* * * * *